US008936533B2

(12) United States Patent
Publicover et al.

(10) Patent No.: US 8,936,533 B2
(45) **Date of Patent: *Jan. 20, 2015**

(54) TRAMPOLINE WITH DUAL SPRING ELEMENTS

(75) Inventors: Mark W. Publicover, Saratoga, CA (US); Jon P. Hylbert, Los Gatos, CA (US)

(73) Assignee: Mark W. Publicover, Saratoga, CA (US)

( * ) Notice: Subject to any disclaimer, the term of this patent is extended or adjusted under 35 U.S.C. 154(b) by 528 days.

This patent is subject to a terminal disclaimer.

(21) Appl. No.: 13/087,637

(22) Filed: Apr. 15, 2011

(65) Prior Publication Data

US 2012/0094807 A1 Apr. 19, 2012

Related U.S. Application Data

(60) Continuation of application No. 12/534,731, filed on Aug. 3, 2009, now Pat. No. 7,927,255, which is a division of application No. 11/535,711, filed on Sep. 27, 2006, now Pat. No. 7,568,997.

(60) Provisional application No. 60/722,841, filed on Sep. 29, 2005.

(51) Int. Cl.

| | |
|---|---|
| ***A63B 5/11*** | (2006.01) |
| ***A63B 5/16*** | (2006.01) |
| *A63B 21/02* | (2006.01) |

(52) U.S. Cl.

CPC *A63B 5/11* (2013.01); *A63B 21/023* (2013.01)
USPC ..... 482/27; 482/26; 482/77

(58) Field of Classification Search

USPC ..... 482/24–31, 23; 182/139; 267/73, 89, 267/141.1, 168; 5/186.1, 187, 188, 199, 5/233

See application file for complete search history.

(56) References Cited

U.S. PATENT DOCUMENTS

| | | | | | |
|---|---|---|---|---|---|
| 1,405,143 | A | * | 1/1922 | McKellar | 245/5 |
| 2,265,555 | A | * | 12/1941 | Tucker | 5/199 |
| 2,858,551 | A | | 11/1958 | Sidlinger | |
| 3,656,737 | A | * | 4/1972 | Smith et al. | 267/73 |
| 3,767,009 | A | * | 10/1973 | Sidlinger | 482/27 |
| 3,841,618 | A | * | 10/1974 | Solomons | 267/110 |
| 4,037,829 | A | | 7/1977 | Crosby | |
| 4,162,063 | A | * | 7/1979 | Nissen et al. | 482/27 |
| 4,452,444 | A | | 6/1984 | Schulze | |
| 4,576,375 | A | | 3/1986 | Roberts | |
| 4,598,904 | A | | 7/1986 | Roth | |
| 4,863,156 | A | | 9/1989 | Shaw | |

(Continued)

*Primary Examiner* — Loan H Thanh
*Assistant Examiner* — Nyca T Nguyen
(74) *Attorney, Agent, or Firm* — Edward S. Sherman

(57) ABSTRACT

A trampoline provides higher performance and greater shock absorption capability by utilizing pairs of springs to connect the rebounding mat to the supporting frame. The springs in each pair are coupled to a common junction on the periphery of the rebounding mat. The upper spring in each pair is directly connected to the rebounding mat and the trampoline frame to initially to tension the mat in the equilibrium position. The lower spring in each pair is coupled to the frame and then to rebounding mat via a linkage arm such that it comes substantially under tension only as the corresponding upper spring is stretched. Depending on the level of impact force on the trampoline mat both springs extend, such that their combined stored energy propels the user upward on the return bounce. However, as each spring pair engages in stages the shock of the users initially landing is gradually absorbed.

7 Claims, 7 Drawing Sheets

(56) References Cited

U.S. PATENT DOCUMENTS

| | | | |
|---|---|---|---|
| 4,880,226 | A | 11/1989 | Krantz |
| 4,938,473 | A | 7/1990 | Lee |
| 5,299,989 | A | 4/1994 | Boyd et al. |
| 5,343,639 | A | 9/1994 | Kilgore et al. |
| 5,370,591 | A | 12/1994 | Jewell et al. |
| 5,729,852 | A | 3/1998 | Rabideau et al. |
| 6,017,292 | A | 1/2000 | Gift et al. |
| 6,053,845 | A | 4/2000 | Publicover et al. |
| 6,129,649 | A | 10/2000 | Yang |
| 6,237,169 | B1 | 5/2001 | Ying |
| 6,261,207 | B1 | 7/2001 | Publicover et al. |
| 6,733,420 | B1 | 5/2004 | Schroeder |
| 6,846,271 | B2 | 1/2005 | Publicover |
| 7,060,001 | B2 | 6/2006 | Publicover |
| 7,094,181 | B2 | 8/2006 | Hall |
| 2003/0036460 | A1 | 2/2003 | Publicover |
| 2003/0104905 | A1* | 6/2003 | Publicover ..... 482/27 |

* cited by examiner

FIG. 2B
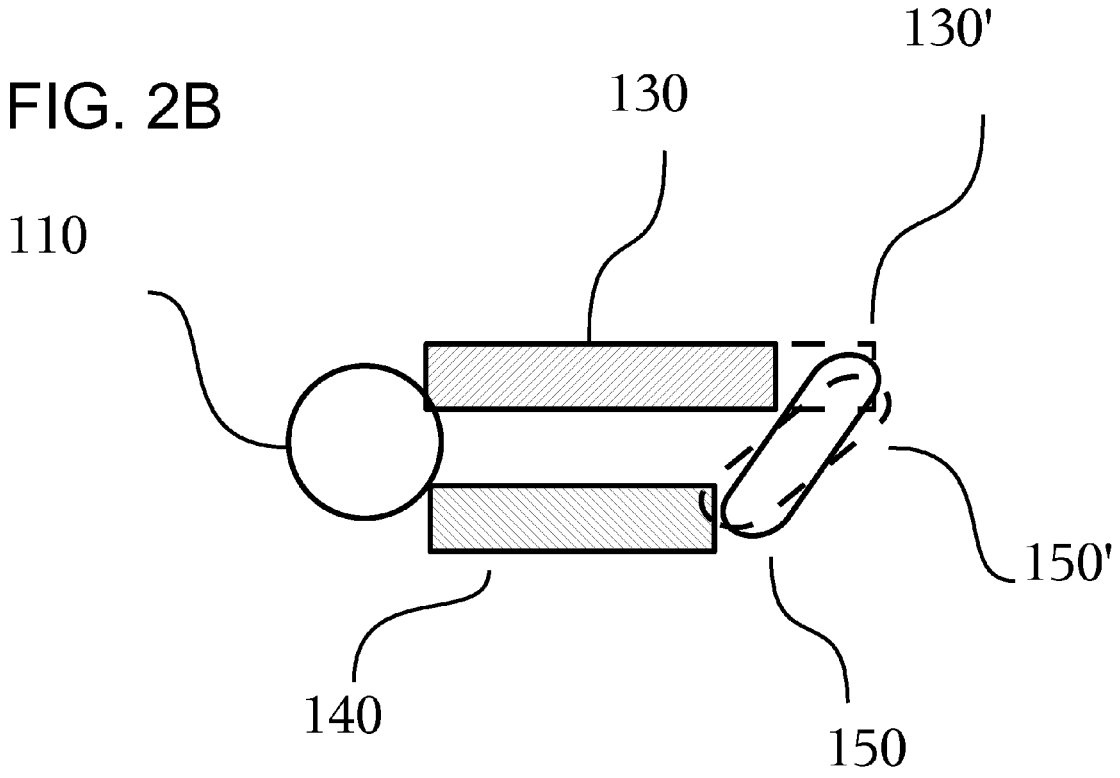
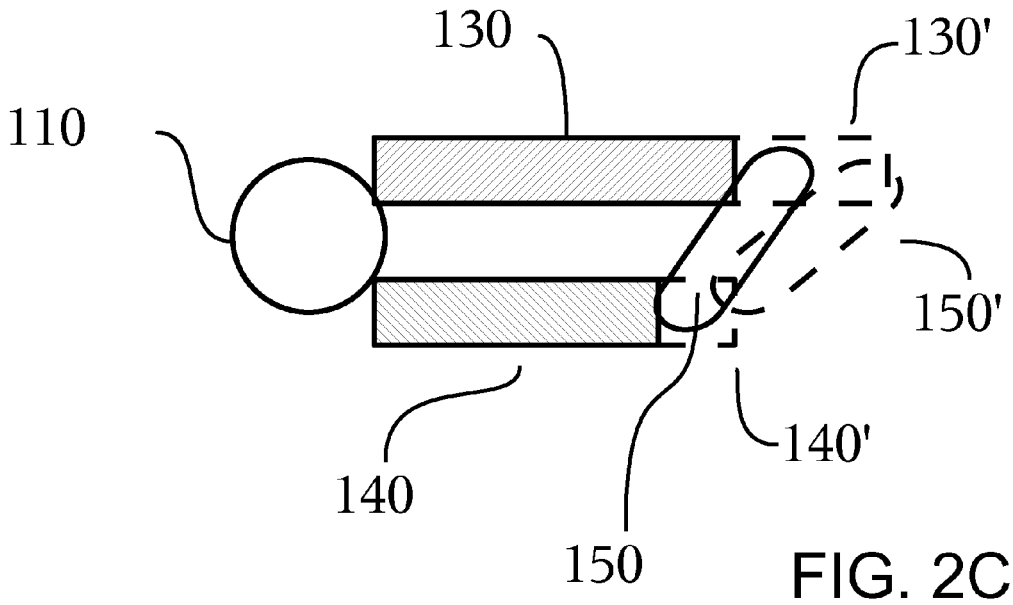
FIG. 2C

TRAMPOLINE WITH DUAL SPRING ELEMENTS

CROSS REFERENCE TO RELATED APPLICATIONS

The present application is a continuation of and claims the benefit of priority to the US Patent application of the same title having application Ser. No. 12/534,731, which itself is a Division of and claims the benefit of priority to the US Patent application of the same title having application Ser. No. 11/535,711 (which issued Aug. 4, 2009 as U.S. Pat. No. 7,568,997), which was filed on Sep. 27, 2006, and in turn claims the benefit of priority to the US provisional patent application of the same title having application Ser. No. 60/722,841, which was filed on Sep. 29, 2005, all of which are incorporated herein by reference.

BACKGROUND OF INVENTION

The present invention concerns jumping surfaces used with trampolines to increase safety and performance for users.

In the past, trampolines have been used for a variety of athletic and recreational purposes. However, thousands of injuries have resulted when persons jumping on a trampoline have landed on the rebounding surface while in an awkward or incorrect body position. These "on-bed" injuries, according to some medical studies, represent the majority of trampoline-related emergency room visits. The U.S. Consumer Products Safety Commission (CPSC) reports that in 1999 approximately 110,000 people were treated in emergency rooms for trampoline related injuries. Even though this number is half that of play structure/swing set injuries, some in the medical community have called for a ban on the sale of backyard trampolines. The CPSC and the AAOS have taken a more responsible and measured approach to problem. Recognizing that other outdoor activities that are more injurious, like bicycling, would fill the void left by backyard trampoline play, these organizations have instead called for safety improvements to help reduce the disturbingly large number of trampoline injuries.

One approach to reducing trampoline injuries has been to form a wall around the perimeter of a trampoline bed or mat so that when a jumper lands too near the edge, the wall prevents the jumper from falling off. Examples are shown in U.S. Pat. Nos. 5,399,132 and 6,053,845, which are incorporated herein by reference. However, these devices do not directly address injuries that result when users impact the rebounding surface incorrectly or while in an awkward position. A second approach, the use of a harness (worn by the jumper) suspended by elastic cords above the rebounding surface, is an effective way to reduce on-bed, or rebound surface impact injuries. However, such harnesses are designed for safely teaching users advanced acrobatics on high-performance competition trampolines by trained professionals, making them largely inappropriate for low-performance backyard trampolines that are used almost entirely for basic jumping activities and not for advanced acrobatics.

All things being equal, a bed or mat with less tension is more forgiving when a jumper first contacts its surface; it absorbs the impact more slowly and will thus reduce the severity and quantity of on-bed injuries. Nevertheless, injuries suffered during an impact with the rebounding surface are still occurring in large numbers on backyard trampoline beds even though these beds are designed to be less responsive and to have less initial surface tension than gymnastic grade, competition trampoline beds. Reducing bed-impact injuries, especially those that occur on backyard trampolines, was one purpose of the present invention, though the art can be used with all trampolines.

Low performance backyard trampolines are used very differently than high performance trampolines used by skilled competitors for training and competition. For instance, many on-bed backyard trampoline injuries occur when multiple jumpers are using the trampoline at the same time as reported in the NEISS data compiled by the CPSC. Because children enjoy playing together most families allow more than one child to jump at the same time even though this practice is strongly discouraged by trampoline manufacturers, the CPSC, and others experts. Competition trampolines are used almost exclusively in disciplined environments for the structured teaching of specific skills. In contrast, backyard trampolines are largely used for fun, unstructured, imaginative play activities that are relished by kids and recommended by child development experts who understand that daily physical activity significantly enhances learning ability and that kids need activities to counterbalance today's over-structured and sedentary lifestyles. Unfortunately, these unstructured trampoline activities generate numerous on-bed injuries when jumpers land on the rebounding surface in an awkward body position or when a jumper lands on a trampoline bed that has been preloaded with the energy from other jumper impacts.

There thus remains a need to reduce the quantity and severity of on-bed injuries that result from such playful activities.

In the applicant's U.S. Pat. No. 6,840,891 (issued Jan. 11, 2005), which is incorporated herein by reference. The aforementioned and other problems are partially resolved in a trampoline system with systematically phased spring elements. Briefly, springs or other elastic connectors used to support a rebounding mat within the frame of a trampoline or the like are attached using methods that systematically vary the tension (or the travel distance required to reach limit of elasticity) between adjacent (or sets of adjacent) springs. These spring attachment methods increase the time it takes a trampoline to absorb a given amount of energy, thus increasing the shock absorption time and thereby reducing the likelihood of an injury. Further, for an existing trampoline that already deploys springs of uniform elastic properties, the aforementioned improvement requires replacing every other spring with softer springs However, replacing alternating springs with softer springs reduces the rebounding performance, which while making the trampoline generally safer, also reduces the potential rebounding performance from the level that would be desired by more skilled or experienced users, who would prefer to bounce higher. In any trampoline for home use, the elasticity and tensioning of the springs, which control the rebounding performance, are generally selected to be suitable for participants of average weight and athletic ability.

For more skilled athletes, it is desirable to provide a trampoline system that affords the opportunity to bounce higher on each rebound, yet at the same time also be more forgiving in preventing injury. The potential for injury being increased, as a user falling from a higher bounce will have a larger acceleration when hit the rebounding mat.

An additional purpose of the present invention is to provide a trampoline system that can accommodate users having a wide range of weights and athletic abilities, with the option to further customize the trampoline rebounding performance to suit individual participants. An additional object of the present invention has been to provide a means for such customization without the need to remove and replace springs, as well as minimize the time required to make such a change. As such, a customizable trampoline system when shared among different users is likely to undergo a change in set up. Therefore, a further object of the present invention has been to provide an adjustable spring tensioning system wherein the tension setting is readily apparent to participants.

SUMMARY OF INVENTION

It is therefore a first object of the present invention to provide a trampoline spring tensioning system that improves shock absorption, is readily adjustably, and yet results in a superior rebounding performance for users that wish to bounce higher.

The aforementioned and other objectives are accomplished by attaching the rebounding mat of a trampoline to the trampoline frame with a plurality of dual spring elements spaced about the perimeter of the rebounding mat. Each dual spring element comprises an upper spring having a proximal end connected to the mat and a distal end connected to the frame. A lower spring is disposed vertically below the upper spring with the distal end thereof connected to the frame. A linkage arm connects the lower spring to the mat proximate the connection point of the upper spring. The linkage arm controls the staged engagement of the lower spring in response to the upper spring being stretched, thus increasing the energy absorbing capacity of the rebounding mat.

As the user hits the rebounding mat upon falling from a bounce the softer upper spring initially extends until the linkage arm eventually is displaced a sufficient distance to urge the stiffer lower spring to extent. The upper spring thus softens the landing, while the lower spring when fully extended couples with the softer spring to urge the participant higher on the return bounce. The onset of the engagement of the stiffer lower spring can be modified by changing the effective length of the linkage arm. Therefore, another aspect of the invention involves providing a linkage arm mechanism having multiple points of attachment with the lower spring to vary the effective length thereof. As the connection position of the linkage arm is readily modified when the rebounding mat is at rest, the aforementioned system allows the rapid modification to accommodate users of differing abilities and weights. Further, the position of the linkage arm connection will be readily apparent as the participant inspects each spring pair while encircling the spring frame.

Accordingly, this inventive trampoline system with dual spring elements can be readily tuned for different age, weight, and skill levels. Even without such tuning, the dual spring system broadens the performance spectrum so that jumpers with a wider range of weights and skill levels can safely enjoy the same setup.

These and other objects of the invention are achieved by providing a kit for adding a plurality of spring elements to a trampoline, the kit comprising a plurality of identical spring connecting modules, wherein each spring connecting module comprises: a spring elongated along a principal axis having a proximal and distal end; a linkage arm elongated along a primary axis that terminates in a first end and a second end opposite the first end, having an aperture at the first end for connecting to the distal end of the corresponding spring in the module, and in which the second end is formed to gaspingly connect to the bed of a trampoline so as to place the distal end of said spring more distal from the end of the trampoline bed than a spring connected thereto when the primary axis of the linkage arm is oriented in the radial direction away from the center of the trampoline and disposed in the same plane as the principal axis of the spring; and means to couple the distal end of each spring to a position below the frame of the trampoline via a hole in the top of the trampoline frame.

The above and other objects, effects, features, and advantages of the present invention will become more apparent from the following description of the embodiments thereof taken in conjunction with the accompanying drawings.

BRIEF DESCRIPTION OF DRAWINGS

FIG. 3A-D illustrate the components in a kit for retrofitting an existing trampoline spring assembly to obtain the configurations of FIG. 1 and FIG. 2, in which FIG. 3D is a perspective view.

DETAILED DESCRIPTION

Figure 1:
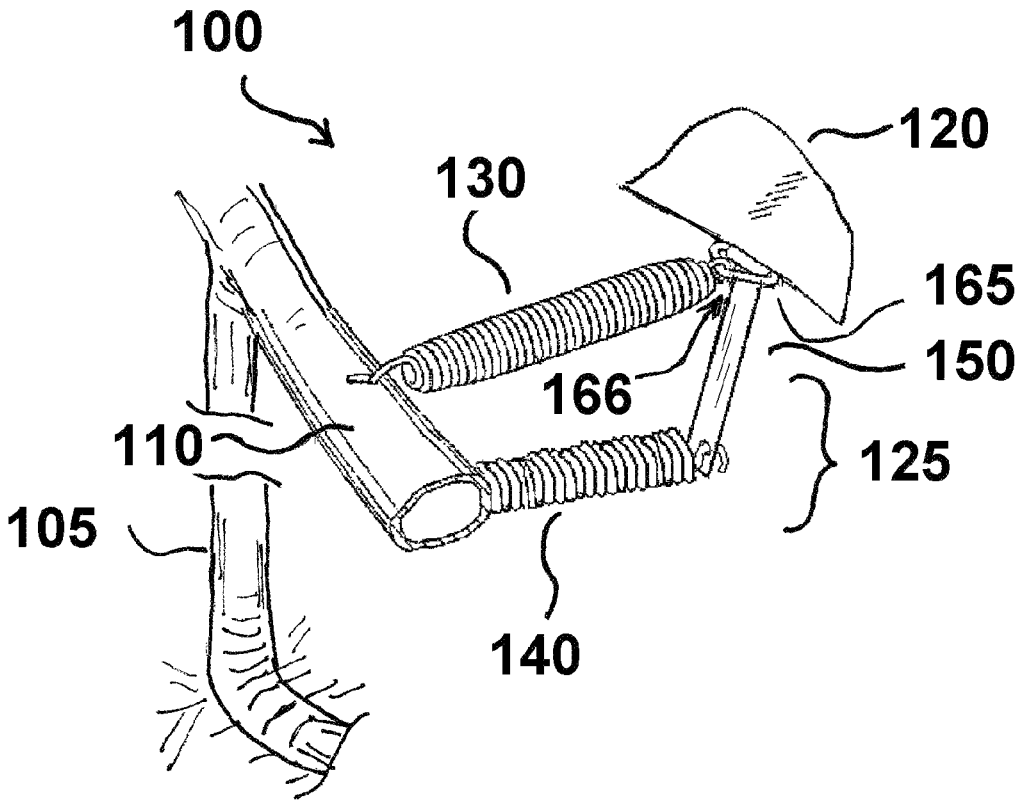
FIG. 1 is a perspective view showing of a portion of a trampoline showing the spring assembly connecting the rebounding mat to the frame.

Referring to FIGS. 1 through 5, wherein like reference numerals refer to like components in the various views, there is illustrated therein a new and improved trampoline with dual spring elements, generally denominated 100 herein, as well as a kit 300 for retrofitting an existing trampoline to have dual spring elements.

Figure 5:
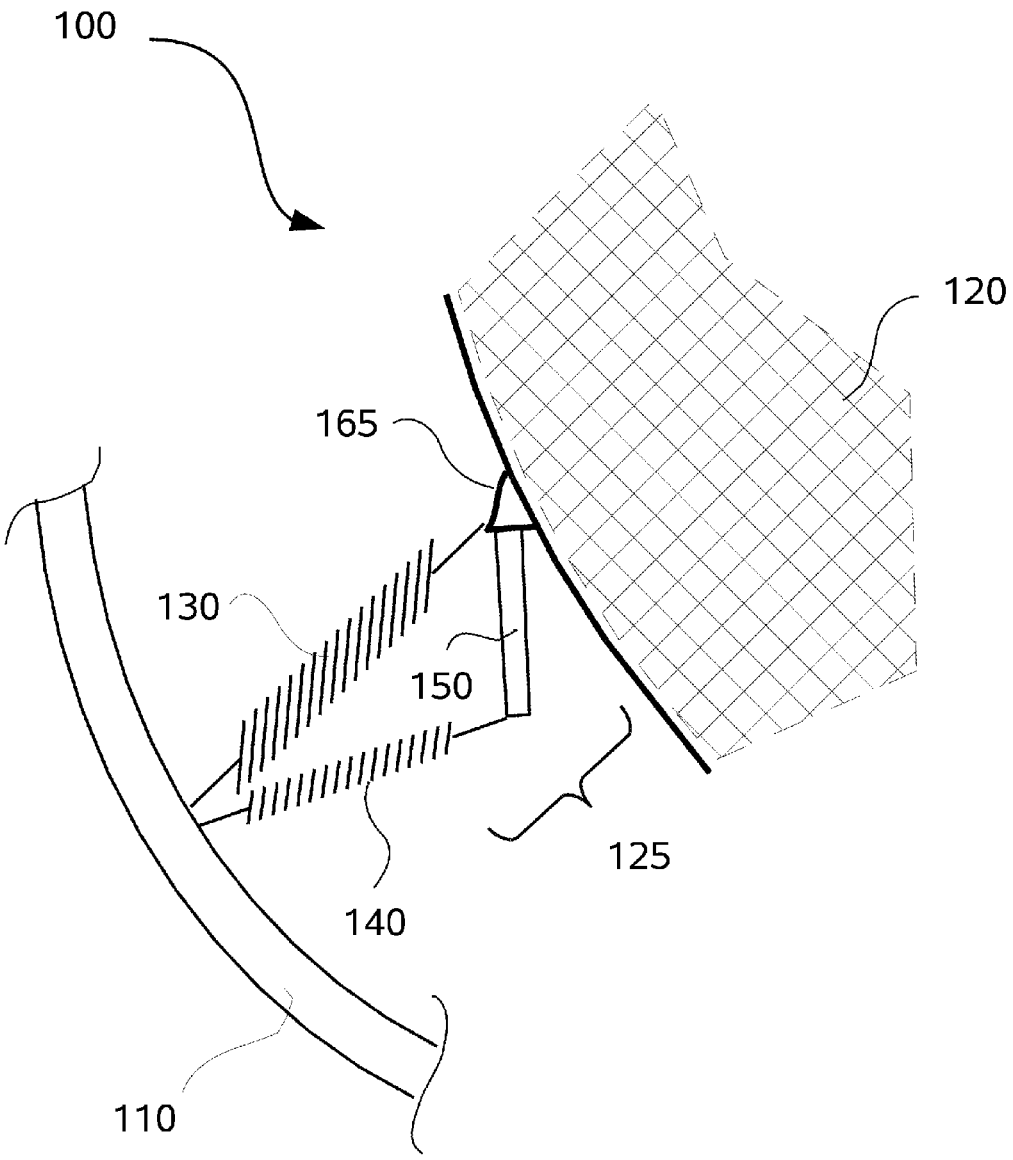
FIG. 5 is a plan view of a portion of a trampoline showing an alternative embodiment of the spring assembly connecting the rebounding mat to the frame.

In accordance with the present invention, FIG. 1 illustrates in perspective view the primary elements of the trampoline 100 with a dual spring assembly. The substantially circular frame 110 is supported above the ground by legs 105. The rebounding mat 120 is connected to the frame by a plurality of dual spring elements 125 evenly spaced around the perimeter, of which one is shown in the Figure. Each dual spring element includes an upper or primary spring 130 and a lower or secondary spring 140. In FIG. 2, spring 130 terminates at the proximal end with hook 135*a* and at the distal end with hook 135*b*. Spring 140 terminates at the proximal end with hook 145*a* and at the distal end with hook 145*b*. As shown in more detail in FIG. 2, the upper spring 130 is directly connected to the rebounding mat 120 via hook 135*a* the proximal end and to the frame via hook 135*b* at the distal end. In alternative embodiments, the proximal end of linkage arm 150 may be shaped or configured to attach to at least one of the spring end hooks 135, the v-ring 165, or any common connecting element. While FIG. 1 illustrates an embodiment in which the primary spring 130 and secondary spring 140 are disposed in a common vertical plane, FIG. 5 illustrates an alternative embodiment in which the primary spring 130 and secondary spring 140 are disposed in a common horizontal plane, each being connected at the distal end to upper side of trampoline frame 110.

In FIG. 2, which is a cross sectional elevation of the same portion of the trampoline as FIG. 1, further illustrates how the lower or secondary spring 140 is connected to the trampoline frame 110. The proximal end 145*a* of lower spring 140 is coupled to the common connection point 166 on the rebounding mat 120 as the upper spring 130 via a linkage arm 150. Specifically, the proximal end 145*a* of lower spring 140 is connected to the distal end 151 of linkage arm 150, whereas the opposite or proximal end 152 of linkage arm 150 is coupled more directly to connection point 166. As shown in this embodiment, connection point 166 is a V-shaped ring 165. Such V-shaped rings are linked to the rebounded mat by a strip of fabric that extends around one side of the triangle that forms the V with the free ends of the strip stitched to the rebounding mat 120. The hook end 135*a* of the upper spring 130 engages with the frame of the V-rings, whereas the V-ring itself may be inserted into a bore 153 in the proximal end 151 of linkage arm 150. The distal end 151 of linkage arm 150 also has a bore 152 for receiving and engaging the hook on the proximal end 145*a* of lower spring 140.

The bore 153 is the hooked over edge of the wire frame perimeter of the last portion of the linkage arm, but may also be the inner diameter of the wire frame at the last segment.

The upper spring 130 is connected at the distal end 135*b* to a hole or bore 111 in the upper side of frame 110. The lower spring 140 is connected at the distal end 145*b* to at least one hole 112 in the lower side of frame 110. It should be appreciated that in this embodiment, the lower side of frame 110 has a second hole 113 for receiving the hook at the distal end 145 *b* of the lower spring, which together with the passage through hole 112, prevents spring 140 from falling from the frame 110 when it is not under tension.

Figure 2A:
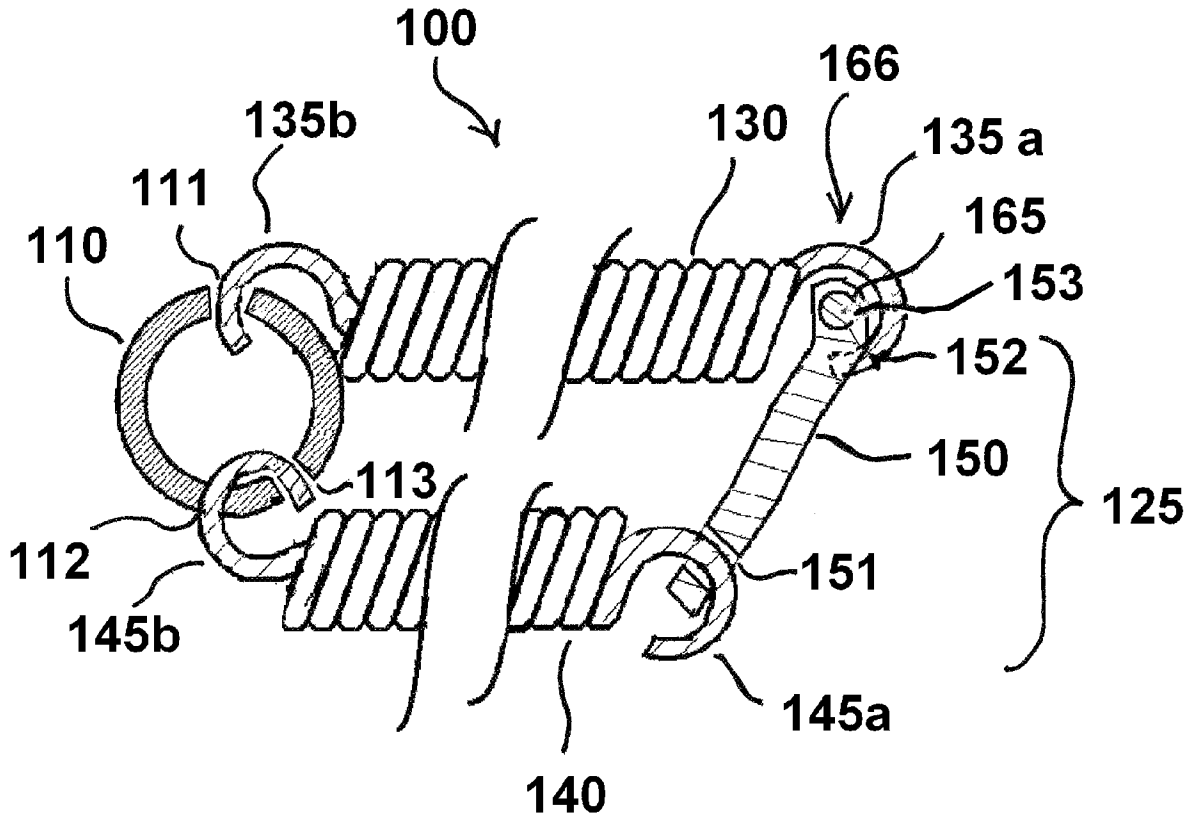
FIG. 2A is an elevation of the spring assembly of FIG. 1, FIGS. 2B and C schematically illustrate the operative principles of the spring assembly as the rebounding mat is displacement from the equilibrium position.

The operative principles of spring assembly in FIG. 1 is now further illustrated with respect to the cross-section in FIG. 2A, and the schematic diagrams thereof in FIGS. 2B and 2C. Taking into account the vertical separation and difference in length between the upper 130 and lower 140 springs, the linkage arm 150 extends at a downward tilt angle toward the frame 110 such that the lower spring is initially relaxed, that is not under tension, when the rebounding mat 120 is at equilibrium. Sufficient force to displace the rebounding mat 120 from the equilibrium position will initially extend only the upper spring 130 (as shown in FIG. 2B in which the extend upper spring 130 is shown in dashed line and labeled 130'), as well as displace and rotate linkage arm 150'. As the upper spring 140 continues to extent with greater displacement of the rebounding mat 120, the distal end 151 of linkage arm 150 is laterally displaced and thus urges the lower spring to extend, as shown in FIG. 2C, in which the extended lower spring 140' is now indicated by a dashed line. Depending on the level of impact force on the trampoline rebounding mat 120 both springs extend, such that their combined stored energy propels the user upward on the return bounce. However, as each spring pair engages in stages the shock of the users initially landing is absorbed more gradually. It should be noted that a preferred embodiment is for springs 130 and 140 to be the same length. However, a variation of spring lengths is also contemplated.

When the trampoline is not being used, the equilibrium position, the upper spring 130 is in tension to stretch the rebounding mat 120, while the lower spring 140 is generally not in tension. When a user jumps or lands on the rebounding mat 120 the lower spring 140 is initially relaxed when the upper spring 130 starts to extend. After the upper spring 130 continues to expand, the linkage arm 150 is extended outward to engage and stretch the lower spring 140. Depending on the level of impact force on the rebounding mat 120 both springs 130 and 140 extend, such that their combined stored energy propels the user upward on the return bounce. However, as each spring pair engages in stages the shock of the user's initial landing is gradually absorbed.

Figure 3:
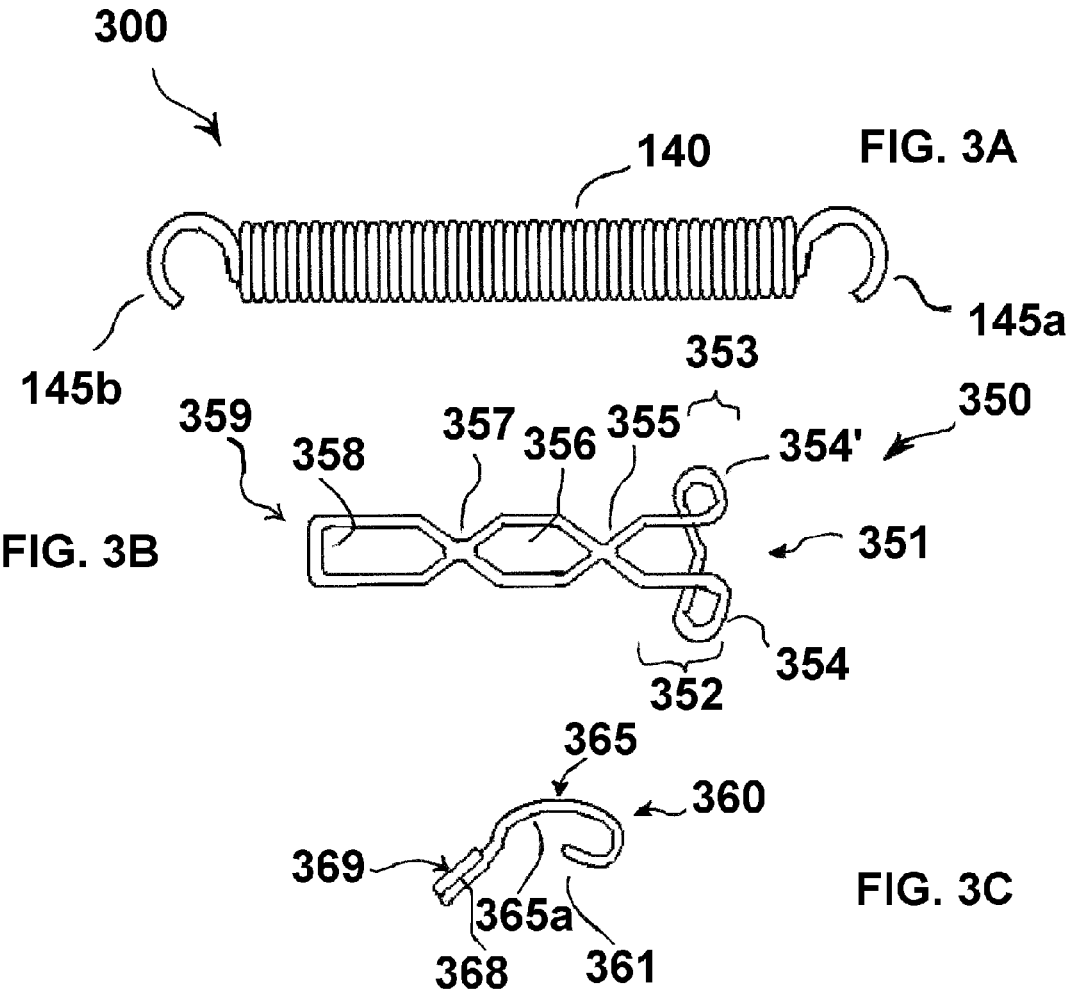

FIG. 3 illustrates another embodiment of the invention in the form of a kit for retrofitting a trampoline. The kit 300 comprises a plurality of secondary springs 140 and linkage arms 350. Linkage arm 350 in FIG. 3B has a proximal end 351 for insertion and engagement with a V-ring 365 and a distal end 359 for receiving the hook at the proximal end 145*a* of lower spring 140. A closed ring 358 having a square end defines the distal end 359 of linkage arm 350. The linkage arm 350 can be formed out of a single rod of stiff metal or multiple metal rods by forming into the shape shown in FIG. 3B with reinforcing welds add at the rods crossing points 355 and 357. It should be noted that welding the crossing points also define a second closed ring 356 (having a semi-diamond shape) located between the distal end 359 and the proximal end 351. The proximal end 351 is also a closed non-circular ring 352, but has a wider portion 353. This wider portion 353 is bent over and folded to be parallel with the plane defined by rings 356 and 358. Folding over the wider portion of ring 352 forms a pair of ring like earlets 354 and 354' at the proximal end 351 of linkage arm 350. The earlets 354 and 354' are provided to slide into a mating engagement with a narrowing corner of the V-ring as the distal end 359 is tensioned by spring 140. The provision of two closed rings 356 and 358 in linkage arm 350 enables the adjustment of the tension in the lower spring 140 by alternatively placing the hook of the proximal end 145*a* to engage the square portion of the distal closed ring 358, or the crossing point 357 of the intermediate closed ring 356, as well as crossing point 355.

Figure 3D:
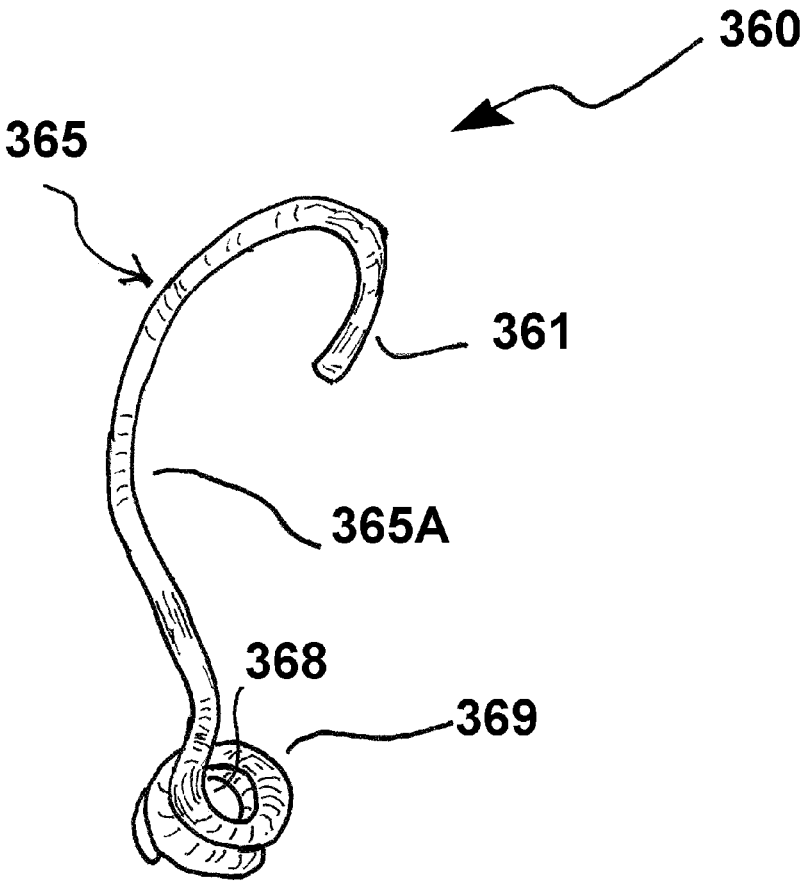

In more preferred embodiments the kit, and trampoline system of FIG. 1, may further comprise a linkage arm frame adaptor 360. FIG. 3C shows a side plan view of linkage arm frame adaptor 360, whereas FIG. 3D is a perspective view. The linkage arm frame adaptor enable the secure attachment of the lower spring 140 to the frame 110 from an existing hole 111 (FIG. 2A) in the upward facing portion of the frame. The linkage arm frame adaptor 360 is also optionally forged out of a thick metal rod. It has a proximal end 361 formed in a hook shape to engage the hole 111 in the circular frame. The distal end 369 is spirally wound to form an eyelet 368. The eyelet 368 is for receiving the hook at the distal end 145*b* of the lower spring 140. The portion 365 of the linkage arm frame adaptor 360 between proximal 361 and distal end 369 is curved to approximate the circular cross-section of the circular frame 110. Thus, when the hook at the proximal end 361 of the adaptor 360 in disposed within hole 111, the curved portion 365 of the adaptor 360 will wrap in a stable position against the circular frame 110, with the inner or concave portion 365*a* making contact therewith. This now stable positioning of adaptor 360 positions the eyelet 368 below the bottom of the circular frame to receive the hook at the distal end 145*b* of the lower spring 140. Thus, use of the adaptor 360 provides a simple means to attach lower spring 140 without drilling one or more holes in an existing trampoline frame 110.

Thus, the linkage arm 350 enables modification of the trampoline system rebounding characteristics to accommodate a large range of participant's weights and athletic abilities with the minimum amount of time to change configurations between different participants.

Figure 4:
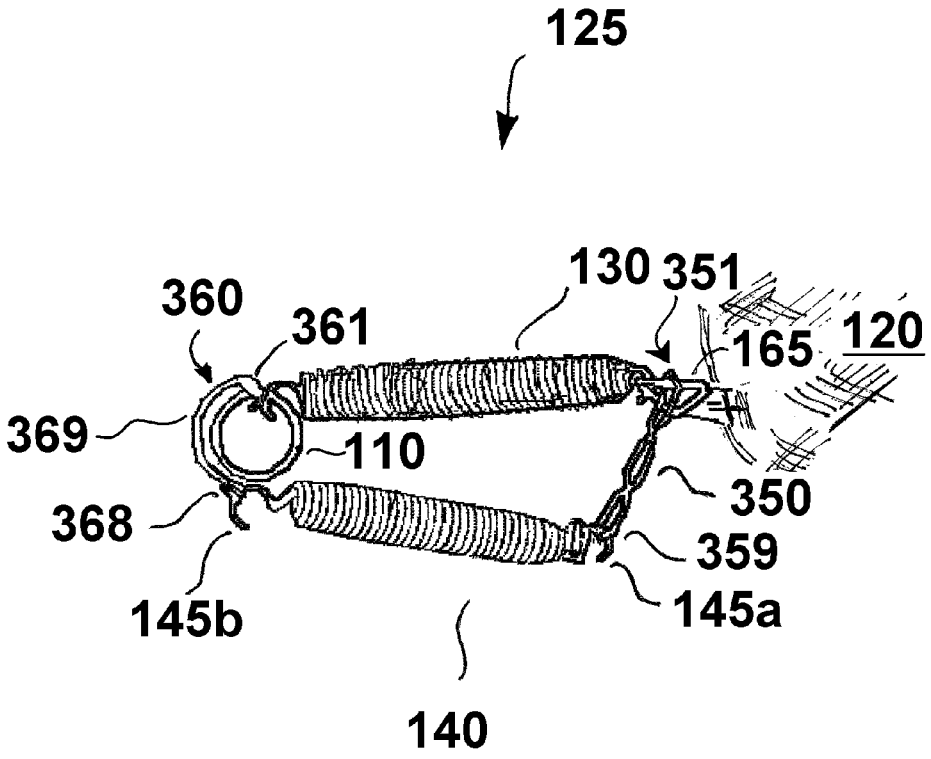
FIG. 4 is a generally a perspective view showing the kit of FIG. 3 installed on a trampoline frame, with the trampoline frame shown in cross section.

It should therefore be understood that the preferred embodiments of the invention deploy a linkage arm comparable to that shown as 350 in FIG. 3B and FIG. 4, which has multiple attachment points for the proximal end 145*a* of the lower spring 140. As the multiple attachment points of linkage arm 350 have different shapes or locations along the linkage arm 150, it will be apparent from the visual inspection of the lower spring 140 connection whether the trampoline has been configured with a high or low tension. The higher tension is preferred for heavier or more rigorous and athletic user's, that is attachment of the proximal end of the lower spring 140 closer to the proximal end of the linkage arm 150. However, to safely accommodate the widest range of user weights and abilities the proximal end of the lower spring 140 should be connected closer to the distal end of the linkage arm 150.

As it is generally desirable that the upper spring is softer than the lower spring (that is has a lower elastic constant), the kit 300 may optionally include a pair of springs of different elasticity to replace the existing spring of a trampoline. This ensures that the user's will have the optimum selection of upper and lower spring properties after retrofitting with the need to measure or specify the model of trampoline they are retrofitting at the time of purchasing the kit.

Another aspect of the invention is a method for retrofitting a trampoline to have dual spring elements wherein the method comprises the steps of providing a frame 110 and a rebounding mat 120 comprising an expanse of trampoline fabric; connecting a plurality of springs pairs 125 that extend around the periphery of the gap between the frame and the mat 120 wherein each spring pair comprises; an upper spring 130 having a proximal end connected to the mat 120 and a distal end connected to the frame 110 for holding the mat 120 in tension, a lower spring 140 disposed vertically below the upper spring with the distal end thereof connected to the frame 110. As previously described, the lower spring 140 is more relaxed than the upper spring 130 when the rebounding mat 120 is at equilibrium. Also connected in the process is linkage arm 150 with its proximal end coupled to proximal end of the upper spring 130 and its distal end coupled to the proximal end of the lower spring 140. The linkage arm 150 is capable of mechanically coupling the lower spring 140 to extend when the upper spring 130 extends from the equilibrium position.

It should be further appreciated that the dual spring assembly 125 and adaptor kit 300 can be deployed on single as well as dual bed trampolines, such as that disclosed in the applicant's U.S. Pat. No. 6,846,271 (issued Jan. 25, 2005), which is incorporated herein by reference. In such instance, it is preferable that the dual spring mechanism be deployed on the upper bed of the trampoline.

While the invention has been described in connection with a preferred embodiment, it is not intended to limit the scope of the invention to the particular form set forth, but on the contrary, it is intended to cover such alternatives, modifications, and equivalents as may be within the spirit and scope of the invention as defined by the appended claims.

We claim:

1. A trampoline system comprising:

a. a frame;

b. a rebounding mat comprising an expanse of trampoline fabric;

c. a plurality of spring sets that extend around a periphery of a gap between said frame and said mat, each of the springs in each of said sets capable of providing an elastic coupling between the rebounding mat and said frame, wherein each spring set comprises:

i. a primary spring having a distal end attached to a hole in the upper portion of the frame, and a proximal end connected to a periphery of the rebounding mat;

ii. a secondary spring adjacent to the primary spring having a distal end coupled to the frame, and a proximal end coupled to the periphery of the rebounding mat by a coupling member, wherein the secondary spring becomes operative after the primary spring is engaged by deflection of said rebounding mat;

wherein the coupling member is a linkage coupling disposed diagonally in a plane common to the primary and secondary spring and is attached at one end of the primary spring to said rebounding mat, the other end attached to the secondary spring.

2. A trampoline system according to claim 1 wherein the coupling member is attached to said rebounding mat.

3. A trampoline system according to claim 2 wherein the point of attachment of the coupling member to said rebounding mat is coincident with the point of coupling of the primary spring to said rebounding mat.

4. A trampoline system according to claim 1 wherein the linkage coupling has a plurality of alternative positions for attaching the secondary spring thereto.

5. A trampoline system according to claim 4 wherein the alternative positions are holes in the linkage coupling.

6. A trampoline system comprising:

a. a frame;

b. a rebounding mat comprising an expanse of trampoline fabric;

c. a plurality of spring sets that extend around a periphery of a gap between said frame and said mat, each of the springs in each of said sets capable of providing an elastic coupling between the rebounding mat and said frame, wherein each spring set comprises;

i. a primary spring having a distal end attached to a hole in the upper portion of the frame, and a proximal end connected to a periphery of the rebounding mat;

ii. a secondary spring adjacent to the primary spring having a distal end coupled to the frame, and a proximal end coupled to the periphery of the rebounding mat by a coupling member;

wherein the coupling member is a linkage arm having at least one opening at a first end for connecting to the proximal end of at least one of the primary and secondary springs in a module, and a second end for connecting to the rebounding mat.

7. A trampoline system according to claim 6 wherein the linkage arm has a plurality of linked segments to provide an open aperture at each linkage for engaging the end of at least one of the first and second springs.

* * * * *